United States Patent [19]

Glover

[11] Patent Number: 5,010,597

[45] Date of Patent: Apr. 30, 1991

[54] GAITER FOR BICYCLING

[76] Inventor: Chris A. Glover, 4 Allison St., Concord, N.H. 03301

[21] Appl. No.: 566,569

[22] Filed: Aug. 13, 1990

[51] Int. Cl.[5] ..... A41B 11/00; A41D 17/02

[52] U.S. Cl. ..... 2/242; 2/46; 2/61; 2/22; 2/23; 2/59; 2/62

[58] Field of Search ..... 2/242, 22, 23, 46, 59, 2/61, 62

[56] References Cited

U.S. PATENT DOCUMENTS

| | | | |
|---|---|---|---|
| 1,299,574 | 4/1919 | Hofto | 2/242 |
| 1,620,743 | 3/1927 | Stuart | 2/242 |
| 1,678,954 | 7/1928 | Rauh | 2/242 |
| 1,708,144 | 4/1929 | Martin | 2/61 |
| 1,708,810 | 4/1929 | Vrabeck | 2/242 |
| 1,782,504 | 11/1930 | Erhardt | 2/242 |
| 1,839,503 | 1/1932 | Russell | 2/242 |
| 2,125,451 | 8/1938 | Kolliner | 2/242 |
| 2,159,119 | 5/1939 | Allen | 2/61 |
| 2,431,287 | 11/1947 | Washington | 2/62 |
| 3,074,405 | 1/1963 | Duensing | 2/22 |
| 3,083,373 | 4/1963 | Rizzotto | 2/63 |
| 3,605,122 | 9/1971 | Myers | 2/242 |
| 4,461,098 | 7/1984 | Diegelman | 2/61 |
| 4,665,562 | 5/1987 | Winer | 2/22 |

FOREIGN PATENT DOCUMENTS

| | | | |
|---|---|---|---|
| 465788 | 6/1950 | Canada | 2/242 |
| 1597 | of 1915 | United Kingdom | 2/242 |

*Primary Examiner*—Werner H. Schroeder
*Assistant Examiner*—Gloria Hale
*Attorney, Agent, or Firm*—William B. Ritchie

[57] ABSTRACT

A gaiter for bicycling providing a plurality of panels to ensure a comfortable fit for various leg sizes. The gaiter incorporates a unique internal pocket capable of holding small items such as keys, change, or ID while bicycling. The gaiter uses one or more light reflective panels enabling the bicyclist to be more easily seen. Use of one or more panels of grease resistant material protects the wearer's clothing from being soiled.

10 Claims, 2 Drawing Sheets

GAITER FOR BICYCLING

BACKGROUND OF THE INVENTION

1. Field of the Invention

The invention relates to protective garments for use in bicycling

2. Description of the Related Art

Bicycling has undergone an unprecedented growth in popularity. It is now common again to consider the bicycle as a means for transportation to and from work as well as riding for the shear pleasure of the sport. With this increased popularity, designs of bicycles have correspondingly changed. Currently, one of the most popular designs is the all terrain type of bicycle which among things has eliminated the use of the chain guard.

Once again, the possibility of catching a trouser in a chain is quite likely despite various design improvements to prevent it. Use of bicycle clips to keep clothing from catching in the chain won't protect against soiling the clothing from the occasional contact with a greased chain or from oil or dirt that may be thrown from the spinning chain.

There are several types of gaiters or lower leg protective equipment specifically designed to protect the wearer during various sporting events. Most of these have been designed for use in sports such as cross-country skiing, football, baseball, and soccer. None of these meets the requirements for use with bicycles.

U.S. Pat. No. 4,001,953, issued to Fugere on Jan. 11, 1977, discloses a protective gaiter for use in sports such as soccer and hockey to protect the limbs of the wearer from impact. The invention features a pocket which extends to cover the shin area down over the foot wherein a pad is inserted to protect the wearer from injury. The device fits over the leg like a sock and is anchored at the foot by a stirrup. Multiple panels are used to construct the body with some of those panels being designated as comprising stretch material. The use material that is resistance to grease or oil is not disclosed.

U.S. Pat. No. 4,306,315, issued to Castiglia on Dec. 22, 1981, discloses a shin guard having an elastic tubular member adapted to fit around the lower leg. This device also fails to disclose a panel that would protect the wearer from the deleterious effects of an unintentional contact with a bicycle chain.

U.S. Pat. No. 2,125,451, issued to Kolliner on Mar. 27, 1936, discloses a device, called a breechette by the inventor, which is designed to protect against the cold. This device specifically claims and distinguishes the use of non-stretchable material.

U.S. Pat. No. 4,665,562, issued to Wimer on May 19, 1987, discloses a leg protecting apparatus for bicyclers. This device covers only a portion of the leg which is likely to come into contact with the bicycle chain and is fastened to the leg with hook and loop fabric fasteners such as Velcro. The panel used for protection is a material that is stated as being grease and moisture resitant but does not disclose that the use of stretchable material for at least one panel to permit the device to give when the leg is flexing during pedaling. The incorporation of a pocket for carrying miscellaneous articles is not disclosed.

The prior art does not suggest or disclose a gaiter for use in bicycling that provides covering for the entire lower leg which can protect grease and oil from staining the rider's clothing and is comfortable and attractive to wear.

SUMMARY OF THE INVENTION

It is object of the invention to provide a bicycling gaiter that has at least one panel of grease resistant material to protect the leg and/or clothing of the wearer from being soiled.

It is another object of the invention to provide a bicycling gaiter that has at least one panel of stretchable material to comfortably fit around the leg of the wearer and fit a range of different leg sizes.

It is another object of the invention to provide a bicycling gaiter that provides a convenient pocket for storing keys, ID, change, and other small articles while bicycling.

It is another object of the invention to provide a bicycling gaiter that can be conveniently fastened and removed using a zipper.

It is still another object of the invention to provide a bicycling gaiter that has a stretchable cuff to permit the gaiter to fit comfortably yet snugly around the wearer's ankle.

It is still a further object of the invention to provide a bicycling gaiter that is fashioned from substantially breathable materials and light in weight so that the wearer will be protected without causing undue discomfort from increased perspiration.

DETAILED DESCRIPTION OF THE INVENTION

Figure 1:
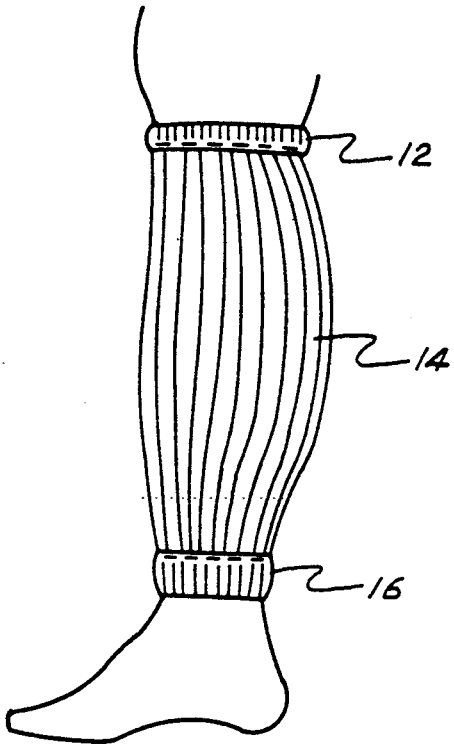
FIG. 1 illustrates a side view of the invention in place on the inside right leg of the wearer.

FIG. 1 illustrates a side view of the invention in place on the outside right leg of the wearer. The embodiment of invention 10 is configured for bicycles having the chain and driving sprocket located on the right side of the bicycle. This is the standard position. For a bicycle having the chain on the left, the preferred embodiment of invention 10 would be the mirror image of the figures shown.

Protective panel 14 is preferably fabricated from 50—50 cotton/polyester knit that is stretchable. All dimensions are designed to fit an average sized woman. To fit other sizes, dimensions should be scaled accordingly. Panel 14 should be approximately 5" wide at top and bottom, and approximately 12" (2" less than the desired overall length)... all dimensions are finished with panel in a non-stretched state. Panel 14 is a double thickness of the knit material to provide extra protection from the chain. Preferably the color selected should be black so that any grease, dirt or oil may contact panel 14 will be difficult to be seen. In an alternative embodiment, panel 14 could be selected from grease or stain resisant material or treated with a non-soiling chemical such as SCOTCHGUARD ®, a product of the 3M Company.

The top invention 10 is finished with binding 12 which is also fabricated of the stretchable material described used for panel 14. Binding 12 is preferably 0.5" wide finished. Binding 12 is stitched to panels with rights together using methods well known in the art.

Cuff 16 is sewn to the bottom of panel 14 which serves to hold invention comfortably in place around the ankle of the wearer. Cuff 16 is also preferably fabricated from the fabric described above. Cuff 16 is preferably 2" wide and approximately 6" long when not stretched.

When in place on the bicyclist, cuff 16 and panel 14 as well as binding 12 are stretched slightly so that invention 10 holds the slacks or trousers of the bicyclist close to the leg to prevent any clothing from being caught or contacting the chain.

Figure 2:
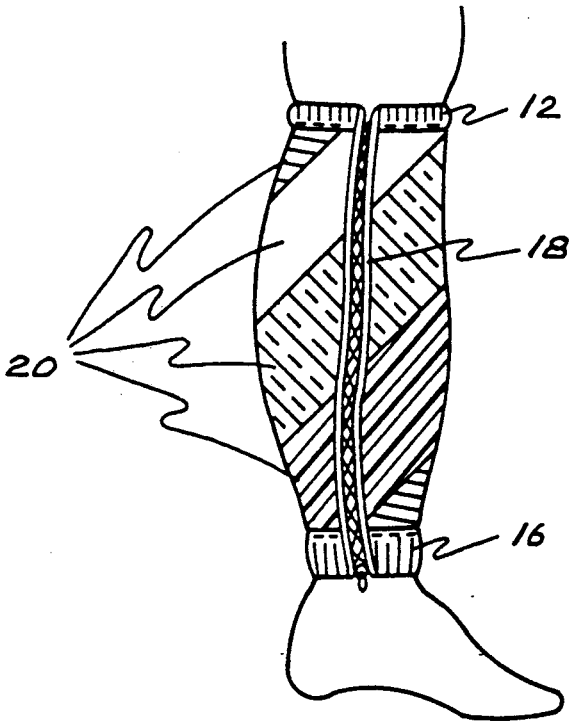
FIG. 2 illustrates a side view of the invention in place on the outside right leg of the wearer.

FIG. 2 illustrates a side view of the invention in place on the outside right leg of the wearer. Support panels 20 are preferably 100% nylon cloth in one or more colors. In the preferred embodiment, five panels are used the top and bottom panel 20 being the same color. In an alternative embodiment one or more of panels 20 could be made from a light reflective material so that the rider could be more easily seen. In the preferred embodiment one panel 20 is a bright red and another is a bright orange which aids the bicyclists in being seen by motor vehicles.

Invention 10 is fastened to the leg by means of zipper 18. In the preferred embodiment a nylon zipper as manufactured by YKK Corporation is used. Zipper 18 is a separating type zipper 14" long with the bottom of zipper 18 located at the top of invention 10. This permits invention 10 to be more easily placed on the leg than if zipper 18 were installed with the top part at the top. As zipper 18 is closed, panel 14, cuff 16 and binding 12 are tensioned slightly around the lower leg of the wearer thereby keeping invention 10 comfortably in place without the use of a stirrup. This also allows the pant leg to be folded in neatly.

Figure 3:
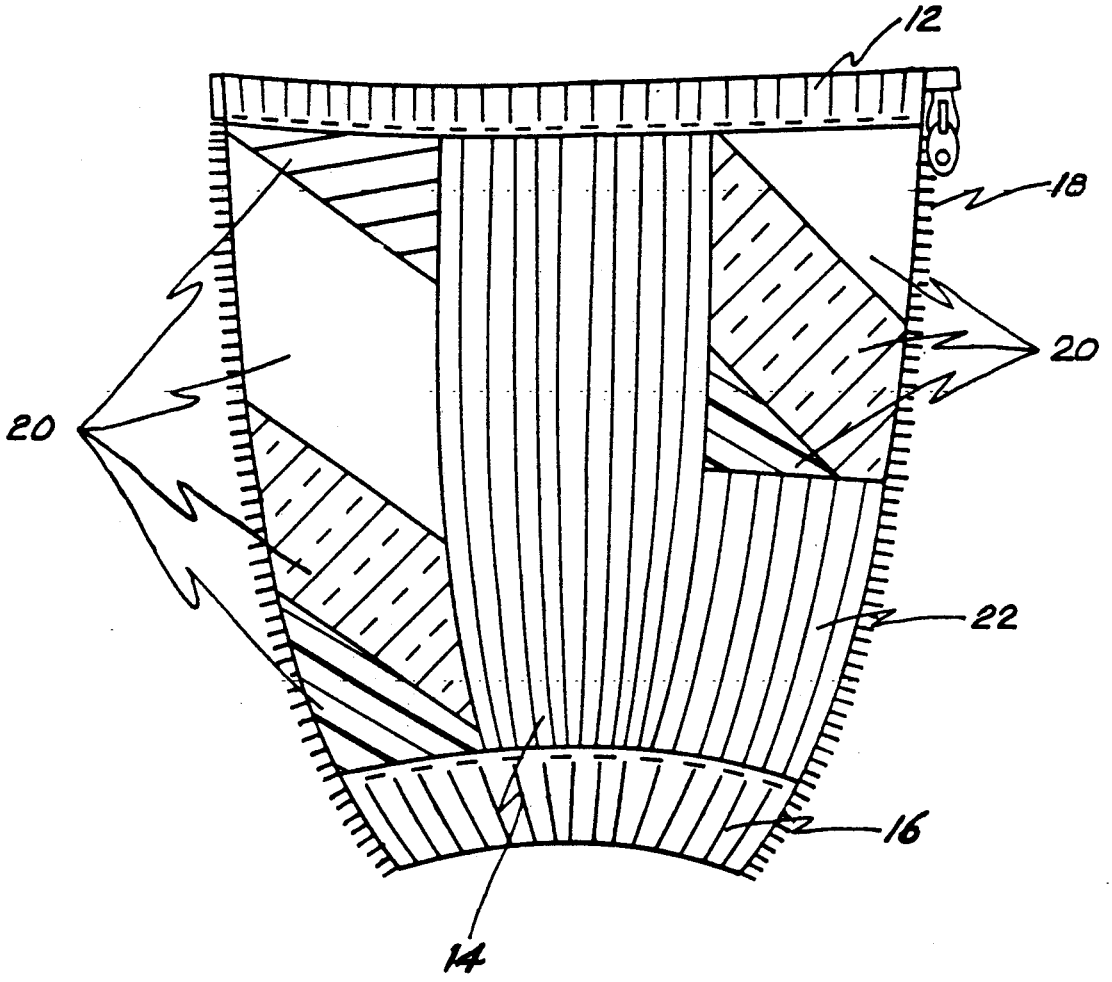
FIG. 3 illustrates an inside front view of the invention of the surface that is placed next to the wearer's leg.

FIG. 3 illustrates an inside front view of the invention of the surface that is placed next to the wearer's leg. Invention 10 is fabricated using sewing techniques well known in the art. Pocket 22, binding 12, panel 14, and cuff 16 are all cut out of knit fabric, preferably a black color. Support panels 20 are cut from nylon fabric, preferably of more than one color. Seam allowances for support panels 20 are preferably ¼" with seams pressed open. The zipper must be separating, made from plastic and of the desired length.

Support panels 20 on the right side of FIG. 3 are designated as "front" support panels 20 and support panels 20 to the left side of FIG. 3 are designated as "back" support panel 20.

Pattern pieces for the various components are laid out on the material selected according to grain lines of the fabric.

Support panels 20 are stitched together with ¼" seam allowance.

Pocket 22 is made by placing right sides of the fabric together and stitching a top seam, ⅜" wide. Then, pocket 22 is turned right side out. A seam ¼" from the top edge is stitched on pocket 22.

Pocket 22 is then placed against wrong side of front support panel 20. The two panels are stitched allowing ¼" seam allowance. The same procedure is repeated for back support panel 20.

With right sides together, front and back support panels 20 are attached to protective panel 14. Front and back support panels are then joined together. The second piece of protective panel 14 is then fastened with side facing wrong side of support panel 20 and stitched together through all layers including pocket 22. The right side out is then turned out with top stitching on protective panel 14 ⅛" from seam.

Cuff 16 is attached to bottom end of the joined support panels 20 and protective panel 14 (hereinafter referred to as "panels"). This is accomplished by placing the right sides together of cuff 16 together to match length of panels, then stitching cuff 16 and panels together allowing ⅜" seam allowance. Press seam allowance to cuff 16.

Position binding 12 to top of panels. With right sides together, streching binding 12 to match length of panels, stitch together with ½" seam allowance. Press seam allowance towards binding 12.

Place a mark 2" down from the top of zipper 18. This mark should line up with the seam between cuff 16 and the panels. Separate zipper 18. With right sides together, place top end of each zipper piece 18 at the bottom of cuff 16. (When in place, the garment will zip open from the bottom.) Stitch each zipper piece 18 to each outer edge of the panels allowing ⅜" seam allowance. The bottom of zipper 18 should meet the edge of panels.

The upper edge of binding 12 is pressured under ½" and the lower edge of cuff 16 is pressed under by ⅜". The edges are turned to the outside along the fold line with right sides together. This step is repeated for binding 12 and cuff 16. Zipper 18 is then stitched from cuff 16 to binding 12 allowing ⅜" seam allowance. Invention 10 is then turned right side out.

The edge of cuff 16 is placed over the seam attaching cuff 16 to the panels. The edge of binding 12 is placed over the seam attaching binding 12 to the panels. The bottom of pocket 22 is eased into cuff 16.

Cuff 16 is top stitched ¼" from edge of cuff 16 and zipper 18. Binding 12 is top stitched ⅛" from edge of binding 12 to complete.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A gaiter for protecting slacks or trousers of a bicyclist from contacting the chain of the bicycle comprising:

a cuff panel of a stretchable material, having top and side edges, adapted to fit snugly around the ankle of the bicyclist to position the slacks or trousers comfortably close to the bicyclist ankle;

a protective panel having bottom and side edges with the bottom edge of said protective panel fastened to the top edge of said cuff panel, said protective panel being a stretchable material sized to substantially cover the inside lower leg of the wearer when tensioned around the lower leg of the bicyclist;

a support panel having top, bottom and side edges, sized to substantially cover the outside lower leg of the wearer with the top edge being greater than the bottom edge to correspond to the differences in the bicyclist's leg circumference from below the knee down to the ankle and sized to cause said protective panel to be tensioned around the bicyclist leg keeping said gaiter comfortably in place during the flexion of the bicyclist's lower leg, said support panel having side edges attached to the side edges of said protective panel;

fastener means, attached adjacent to a mid point between side edges of said cuff panel and the side edges of said protective panel, for releasable joining said gaiter to the lower leg of said bicyclist;

pocket panel, substantially rectangular in shape, attached to the lower portion of said support panel along three sides to form a pocket open at the top, adapted to hold the bicyclist's small items while bicycling.

2. The gaiter in claim 1 wherein said support panel further comprises a plurality of diagonal members with at least one diagonal member adapted to be visible at a distance.

3. The gaiter in claim 2 wherein said fastener means is a zipper.

4. The gaiter in claim 3 wherein said cuff panel further comprises cotton-polyester knit.

5. The gaiter in claim 4 wherein said protective panel further comprises cotton-polyester knit.

6. The gaiter in claim 5 wherein said pocket panel further comprises cotton-polyester knit.

7. The gaiter in claim 6 wherein said pocket panel is sewn to the inside surface of said support panel.

8. The gaiter in claim 7 wherein said support panel comprises nylon fabric.

9. The gaiter in claim 2 wherein said diagonals members of said support panel further comprises at least one panel having a light reflective material.

10. The gaiter in claim 7 wherein said support panel comprises stretchable knit fabric.

* * * * *